US009548571B2

(12) United States Patent
Deng

(10) Patent No.: US 9,548,571 B2
(45) Date of Patent: Jan. 17, 2017

(54) CONNECTOR SOCKET

(71) Applicant: SHENZHEN LITCKCONN TECHNOLOGY CO., Ltd., Shenzhen, Guangdong (CN)

(72) Inventor: Huilun Deng, Guangdong (CN)

(73) Assignee: SHENZHEN LITCKCONN TECHNOLOGY CO.,LTD, Shenzhen, Guangdong (CN)

( * ) Notice: Subject to any disclaimer, the term of this patent is extended or adjusted under 35 U.S.C. 154(b) by 0 days.

(21) Appl. No.: 14/932,459

(22) Filed: Nov. 4, 2015

(65) Prior Publication Data

US 2016/0134059 A1 May 12, 2016

(30) Foreign Application Priority Data

Nov. 7, 2014 (CN) ..... 2014 2 0661479 U

(51) Int. Cl.

| | |
|---|---|
| ***H01R 13/6581*** | (2011.01) |
| ***H01R 24/60*** | (2011.01) |
| ***H01R 13/405*** | (2006.01) |
| *H01R 107/00* | (2006.01) |

(52) U.S. Cl.

CPC ..... *H01R 13/6581* (2013.01); *H01R 13/405* (2013.01); *H01R 24/60* (2013.01); *H01R 2107/00* (2013.01)

(58) Field of Classification Search

CPC .. H01R 13/6581; H01R 24/60; H01R 2107/00
USPC ..... 439/607.01
See application file for complete search history.

(56) References Cited

U.S. PATENT DOCUMENTS

| | | | | |
|---|---|---|---|---|
| 9,306,336 | B2 * | 4/2016 | Chang | H01R 13/6471 |
| 2016/0036169 | A1 * | 2/2016 | Hu | H01R 13/6585 439/607.05 |

* cited by examiner

*Primary Examiner* — Abdullah Riyami
*Assistant Examiner* — Justin Kratt
(74) *Attorney, Agent, or Firm* — Jackson IPG PLLC; Demian K. Jackson

(57) ABSTRACT

A connector socket comprises a shielding shell, an insulating body and two baffles disposed on two opposite sides of the insulating body, and further comprises two rows of contact terminals and a spacer all embedded into the insulating body, the insulating body comprises a base and a tongue plate connected to a front end of the base, the two rows of contact terminals are exposed from two opposite sides of the tongue plate, respectively, the two baffles are disposed to correspond to the sides where the two rows of contact terminals are located, respectively; the spacer is located between the two rows of contact terminals so as to isolate the two rows of contact terminals from one another; a plurality of positioning holes for reinforcing the firmness of connection between the spacer and the insulating body are formed on the spacer.

11 Claims, 15 Drawing Sheets

CONNECTOR SOCKET

FIELD OF THE INVENTION

The present invention relates to the technical field of electric connectors, in particular to a connector socket.

BACKGROUND OF THE INVENTION

At present, connectors have been widely applied in electronic products for data transmission, charge, video transmission and other functions. With the development demand and trend of light and thin electronic products (for example, various ultra-thin tablets, mobile phones, two-in-one boxes, other special mobile devices, etc.), connectors are becoming lighter and thinner in order to conform to the corresponding size of electronic products. As the size of connectors becomes smaller, the size of corresponding structural components is limited and the distance between an upper row of contact terminals and a lower row of contact terminals becomes smaller too. Accordingly, new problems appear: interference of signal is caused between the upper row of contact terminals and the lower row of contact terminals, and it is likely to result in unstable data transmission as the conventional shielding structure design is unable to provide for good shielding effect; and, the structure for assembling the upper row of contact terminals and the lower row of contact terminals within an insulating base is also unstable or complicated in procedure.

Therefore, it is urgent to propose a new technical solution to solve the above problems.

SUMMARY OF THE INVENTION

Accordingly, in view of the deficiencies of the prior art, a main objective of the present invention is to provide a connector socket. The connector socket provided by the present invention is simple in structure, easy to manufacture, and firm in positioning between assembly components, and the technical solution thereof is widely applied to connector sockets of various styles and models.

To achieve the above objective, the present invention employs the following technical solution.

A connector socket is provided, including a shielding shell, an insulating body and two baffles disposed on two opposite sides of the insulating body, and further including two rows of contact terminals and a spacer all embedded into the insulating body, wherein the insulating body includes a base and a tongue plate connected to a front end of the base, the two rows of contact terminals being exposed from two opposite sides of the tongue plate, respectively, the two baffles being disposed to correspond to the sides where the two rows of contact terminals are located, respectively; the spacer is located between the two rows of contact terminals so as to isolate the two rows of contact terminals from one another; a plurality of positioning holes for reinforcing the firmness of connection between the spacer and the insulating body are formed on the spacer, and filled with insulating material during forming the insulating body; and the shielding shell encloses the base and the tongue plate, and a slot is formed between the outer wall of the tongue plate and the inner wall of the shielding shell.

As a preferred solution, a positioning pin and a locking pin are integrally extended from each of the baffles towards the insulating body and a positioning slot and a locking slot are correspondingly formed on the insulating body, the positioning pin being embedded into the positioning slot; and a clamping bulge is convexly provided on the locking pin, the clamping bulge being in close fit with the inner wall of the locking slot when the locking pin is embedded into the locking slot.

As a preferred solution, in a plug-in direction, a plurality of welding pins extending towards a same direction are integrally provided at an end of the shielding shell, and positioning columns extending towards a same direction are integrally provided at an end of the insulating body; welding portions of the two rows of contact terminals are curvedly extended towards the side of the insulating body where the contact portions are located; the spacer includes a first spacer portion corresponding to the tongue plate and a second spacer portion corresponding to the base, a contact bulge being outwards convexly provided on a side edge of the second spacer portion, the contact bulge being connected to the inner wall of the shielding shell in a close contact manner.

As a preferred solution, the two rows of contact terminals are separately embedded into respective terminal ports by primary embedment molding, the two terminal ports being assembled in a superposed manner, a positioning recess and a positioning lug which are fitted with each other being provided on the assembling faces of the terminal ports respectively, the positioning lug being embedded into the positioning recess of the opposite terminal port; a downward-opening channel is formed on the spacer corresponding to a position where the positioning lug and the positioning recess are assembled together; and, the two terminal ports, the two rows of contact terminals and the spacer are formed within the insulating body by secondary embedment molding.

As a preferred solution, welding portions of the two rows of contact terminals are curvedly extended in a vertical plug-in direction, respectively, and the welding portions of the two rows of contact terminals are arranged oppositely; and, the connector socket is of a vertical structure, with a welding portion thereof being of a surface mount structure.

As a preferred solution, two side faces of the shielding shell are integrally extended downwards to form a plurality of welding pins in the vertical plug-in direction; the two rows of contact terminals are arranged up and down, the upper row of contact terminals being separately formed within one terminal port by primary embedment molding, the terminal port, the upper row of contact terminals, the spacer and the lower row of contact terminals being formed within the insulating body by secondary embedment molding; a downward-opening notch convenient for the installation of a circuit board is formed on the bottom at the end of the insulating body in the plug-in direction, the welding portions of the upper row of contact terminals being protruded from the bottom of the insulating body and exposed into the downward-opening notch, the exposed portion being of a surface mount structure extending in the plug-in direction; and, the welding portions of the lower row of contact terminals are curvedly protruded downwards in front and rear rows and exposed into the downward-opening notch, and the exposed portion is of a perforated plug-in structure.

As a preferred solution, two side faces of the shielding shell are integrally extended downwards to form a plurality of welding pins in the vertical plug-in direction; the two rows of contact terminals are arranged up and down, the upper row of contact terminals being separately formed within one terminal port by primary embedment molding, the terminal port, the upper row of contact terminals, the spacer and the lower row of contact terminals being formed within the insulating body by secondary embedment molding; a downward-opening notch convenient for the installation of a circuit board is formed on the bottom at the end of the insulating body in the plug-in direction, the welding portions of the upper row of contact terminals and the lower row of contact terminals being protruded from the bottom of the insulating body and exposed into the downward-opening cavity in respective rows, the exposed portion being of a surface mount structure extending in the plug-in direction.

As a preferred solution, the spacer includes a main body portion and two welding pin portions integrally extending from two sides of the rear end of the main body portion and curvedly protruding from the bottom of the insulating body, and the welding pin portions and the welding pins of the shielding shell are arranged in a same direction.

As a preferred solution, the terminal ports are convexly provided thereon with limiting lugs for facilitating the firm positioning of the terminal ports and the insulating body.

Compared with the prior art, the present invention has apparent advantages and beneficial effects. Specifically, it can be seen from the above technical solution that the structure design of the shielding shell, the insulating body, the two baffles, the two rows of contact terminals and the spacer and the assembly relationship thereof allow the positioning between assembly components to be quite firm; particularly, the positioning between the upper and lower terminal groups is more accurate and firm, so that it is advantageous for the improvement of the contact performance of terminals and the stable signal transmission is ensured; moreover, each component is simple in structure and easy to manufacture, and the technical solution of the present invention is widely applied to connector sockets of various styles and models.

To explain the structural features and functions of the present invention more clearly, the present invention will be described as below in details with reference to the accompanying drawings by specific embodiments.

DETAILED DESCRIPTION OF THE PREFERRED EMBODIMENTS

Figure 1:
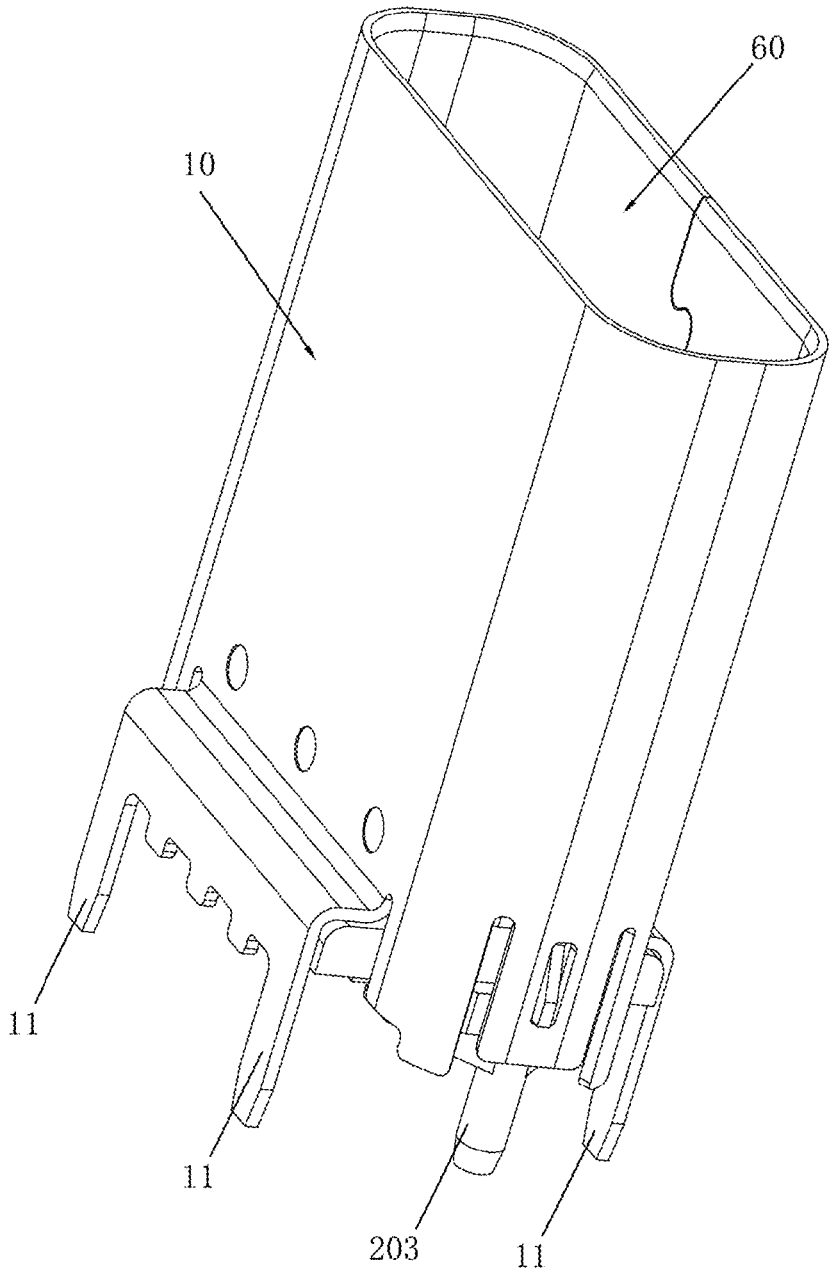
FIG. 1 is a stereoscopic assembly diagram according to Embodiment 1 of the present invention.
Figure 2:
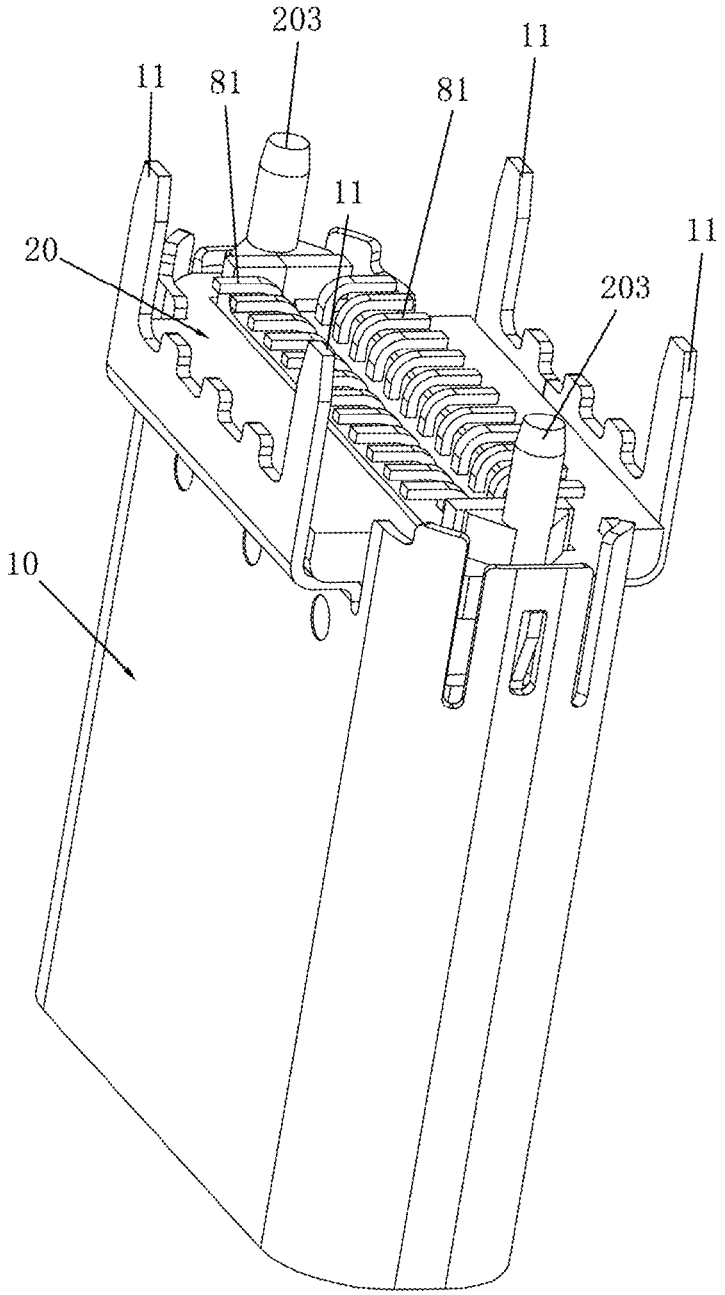
FIG. 2 is a stereoscopic assembly diagram from another perspective according to Embodiment 1 of the present invention.

Referring to FIG. 1 to FIG. 15, the specific structures of multiple embodiments of the present invention are shown. The technical solution of the present invention is widely applied to connector sockets of various styles and models. Here, the following three embodiments are selected for description.

As shown in FIG. 1 to FIG. 5, one embodiment of an vertical connector socket is shown, including a shielding shell 10, an insulating body 20 and two baffles 30 disposed on two opposite sides of the insulating body 20, and further including two rows of contact terminals 41 and a spacer 50 all embedded into the insulating body 20.

The insulating body 20 includes a base 21 and a tongue plate 22 connected to a front end of the base 21, the two rows of contact terminals 41 being exposed from two opposite sides of the tongue plate 22, respectively, the two baffles 30 being disposed to correspond to the sides where the two rows of contact terminals 41 are located, respectively. In this embodiment, a positioning pin 31 and a locking pin 32 are integrally extended from each of the baffles 30 towards the insulating body 20 and a positioning slot 201 and a locking slot 202 are correspondingly formed on the insulating body 20, the positioning pin 31 being embedded into the positioning slot 201; and a clamping bulge 321 is convexly provided on the locking pin 32, the clamping bulge 321 being in close fit with the inner wall of the locking slot 202 when the locking pin 32 is embedded into the locking slot 202 (as shown in FIG. 3).

Figure 5:
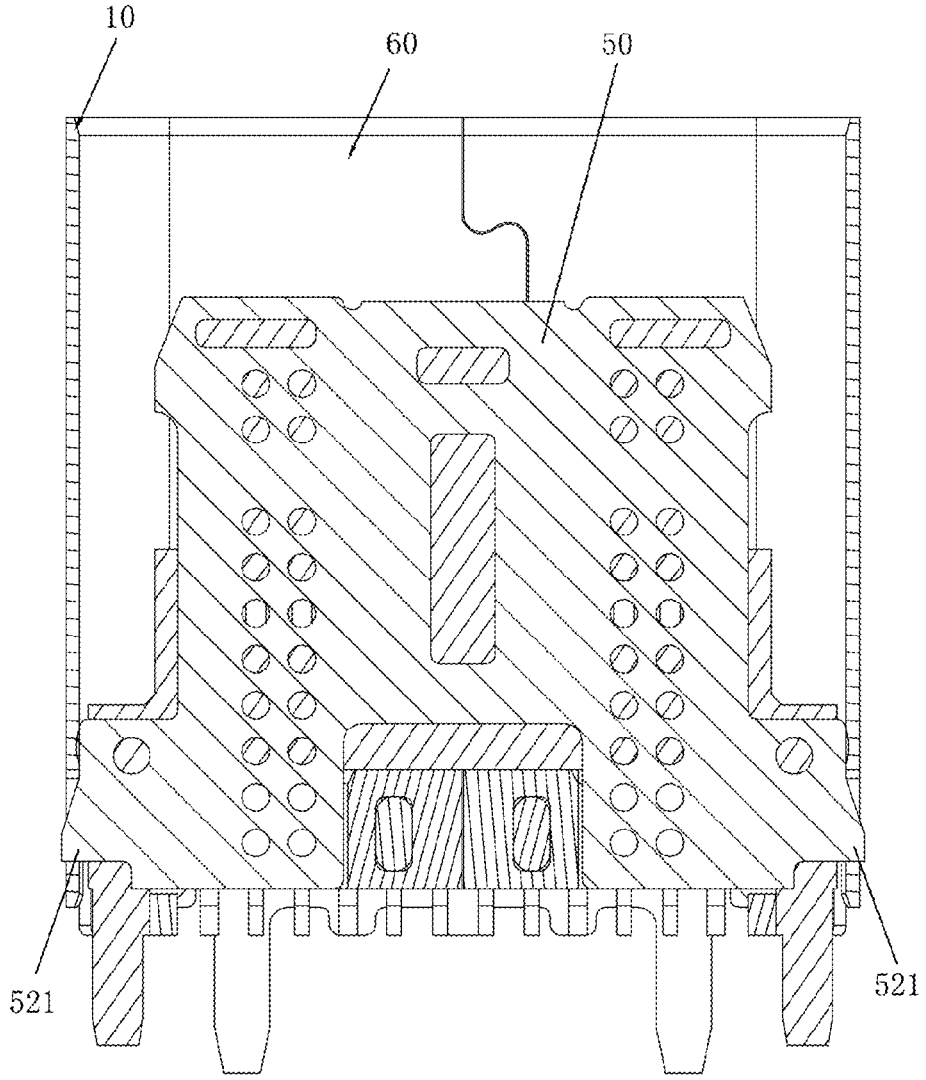
FIG. 5 is a second cross-sectional structure diagram according to Embodiment 1 of the present invention.
Figure 6:
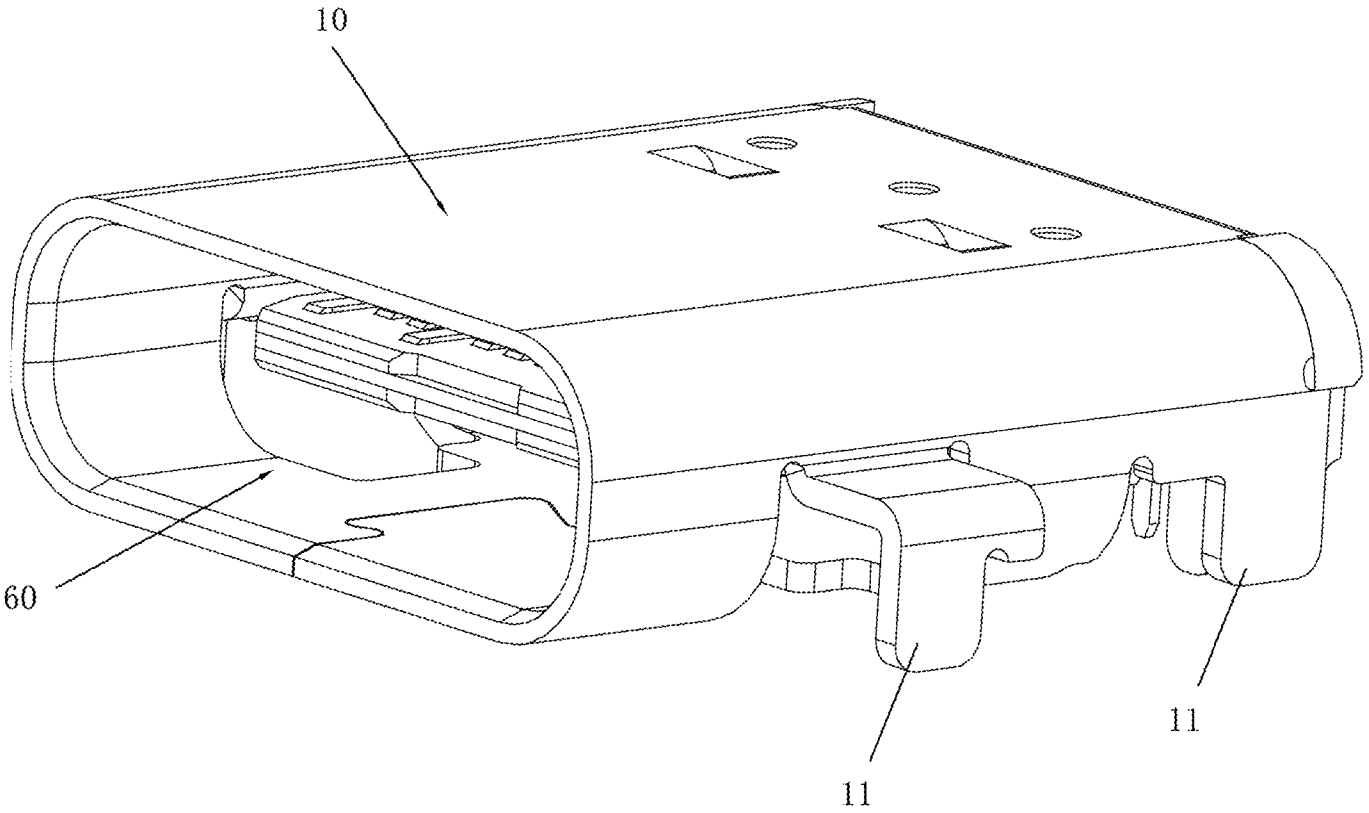
FIG. 6 is a stereoscopic assembly diagram according to Embodiment 2 of the present invention.
Figure 7:
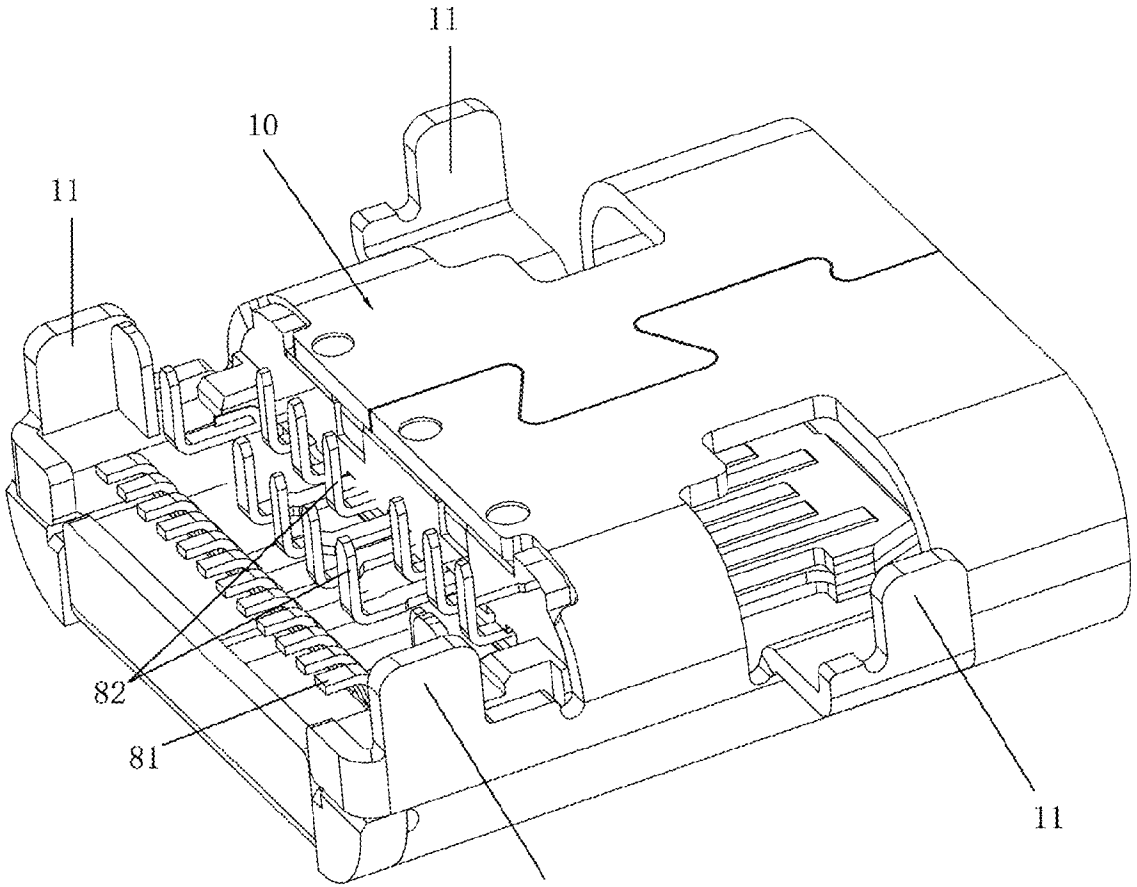
FIG. 7 is an assembly diagram from another perspective according to Embodiment 2 of the present invention.
Figure 8:
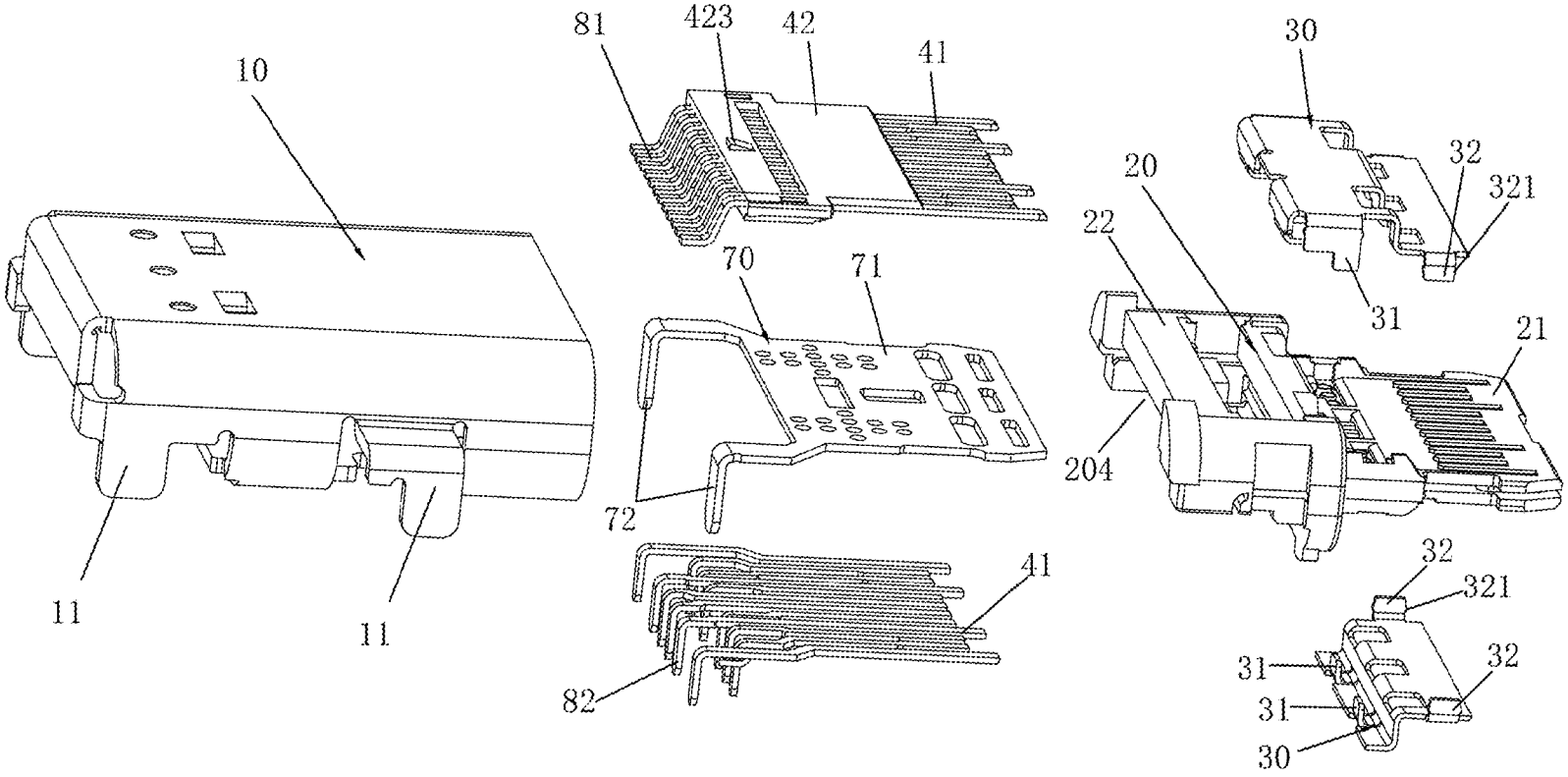
FIG. 8 is a first structural decomposition diagram according to Embodiment 2 of the present invention.
Figure 9:
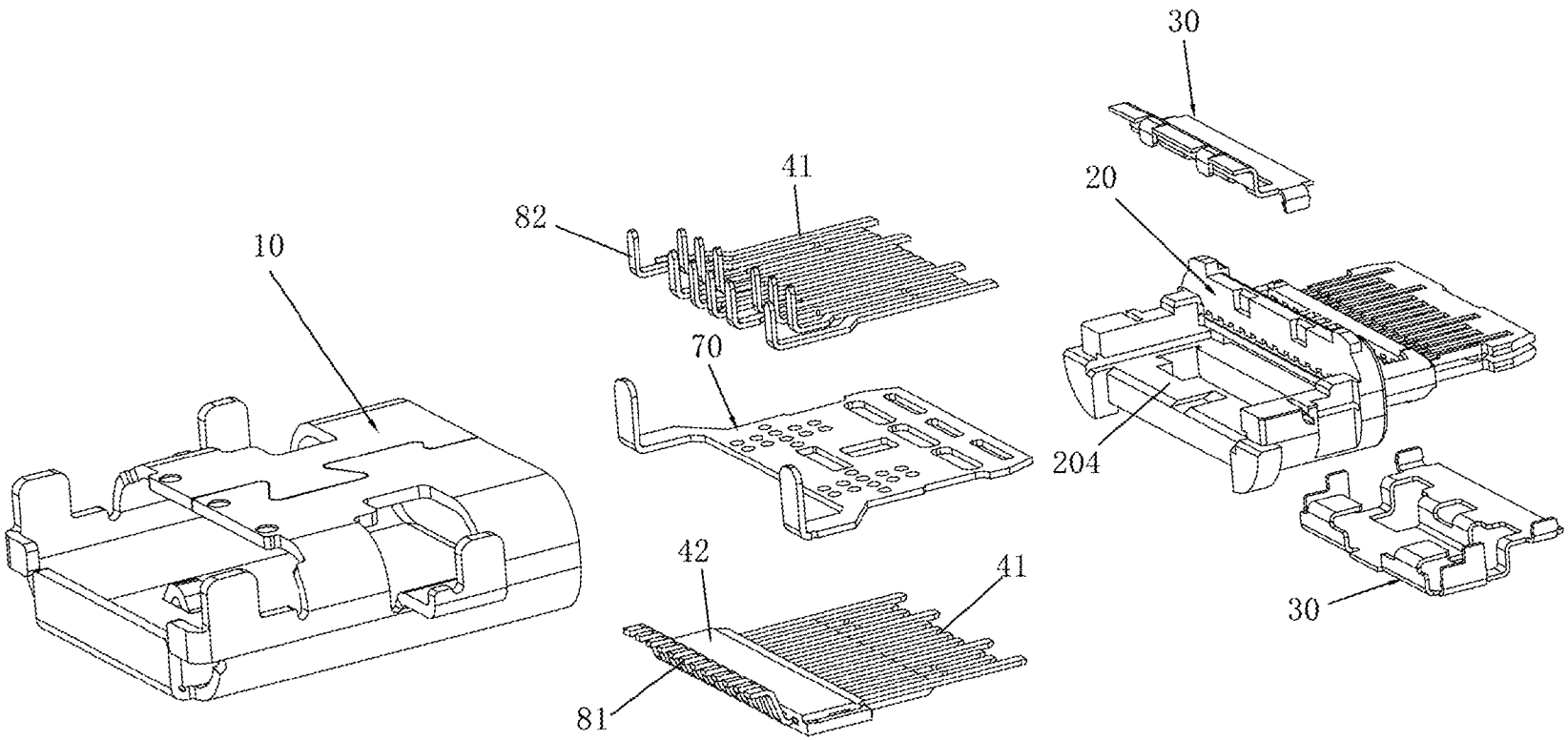
FIG. 9 is a second structural decomposition diagram according to Embodiment 2 of the present invention.
Figure 10:
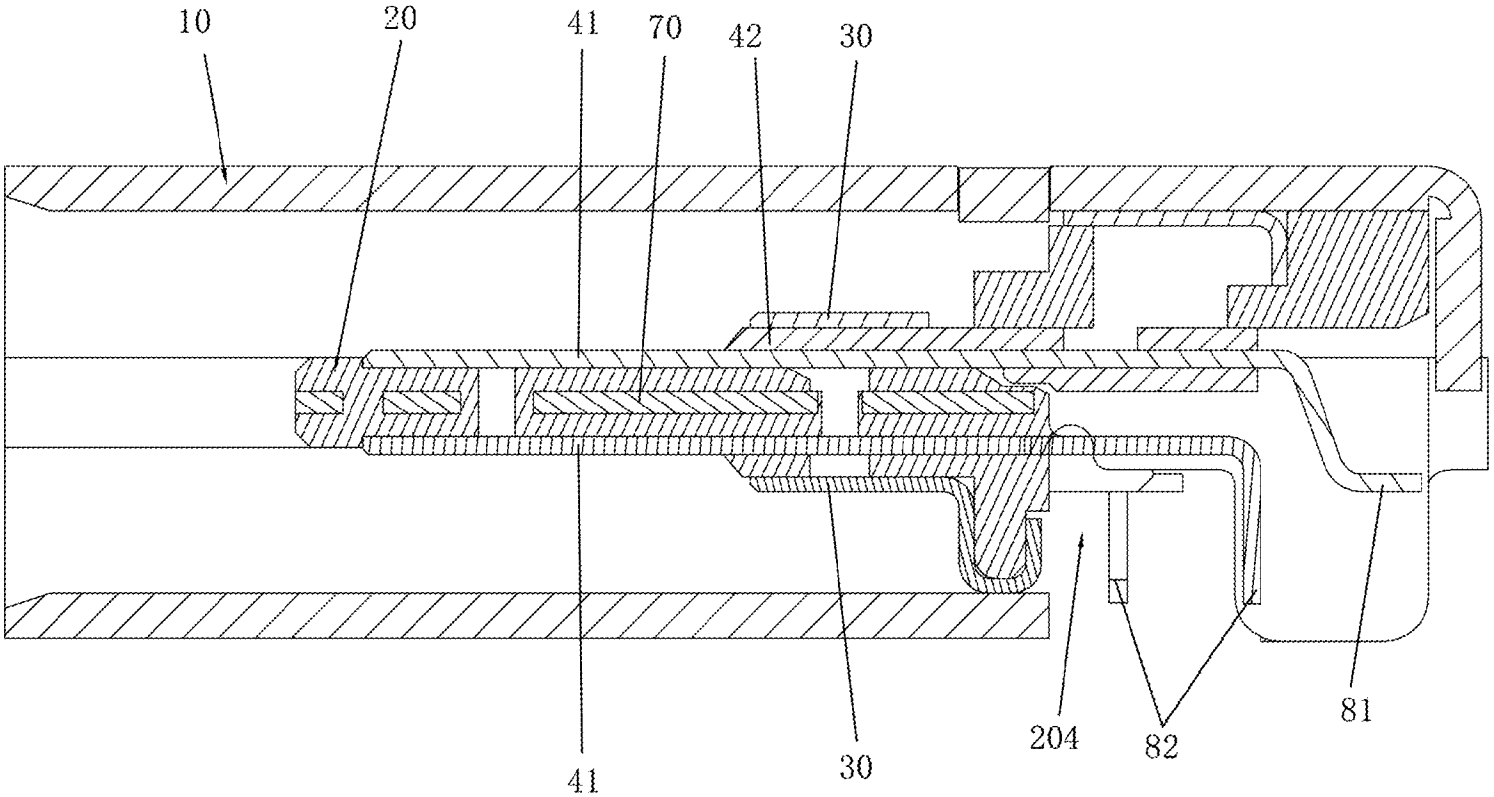
FIG. 10 is a cross-sectional structure diagram according to Embodiment 2 of the present invention.
Figure 11:
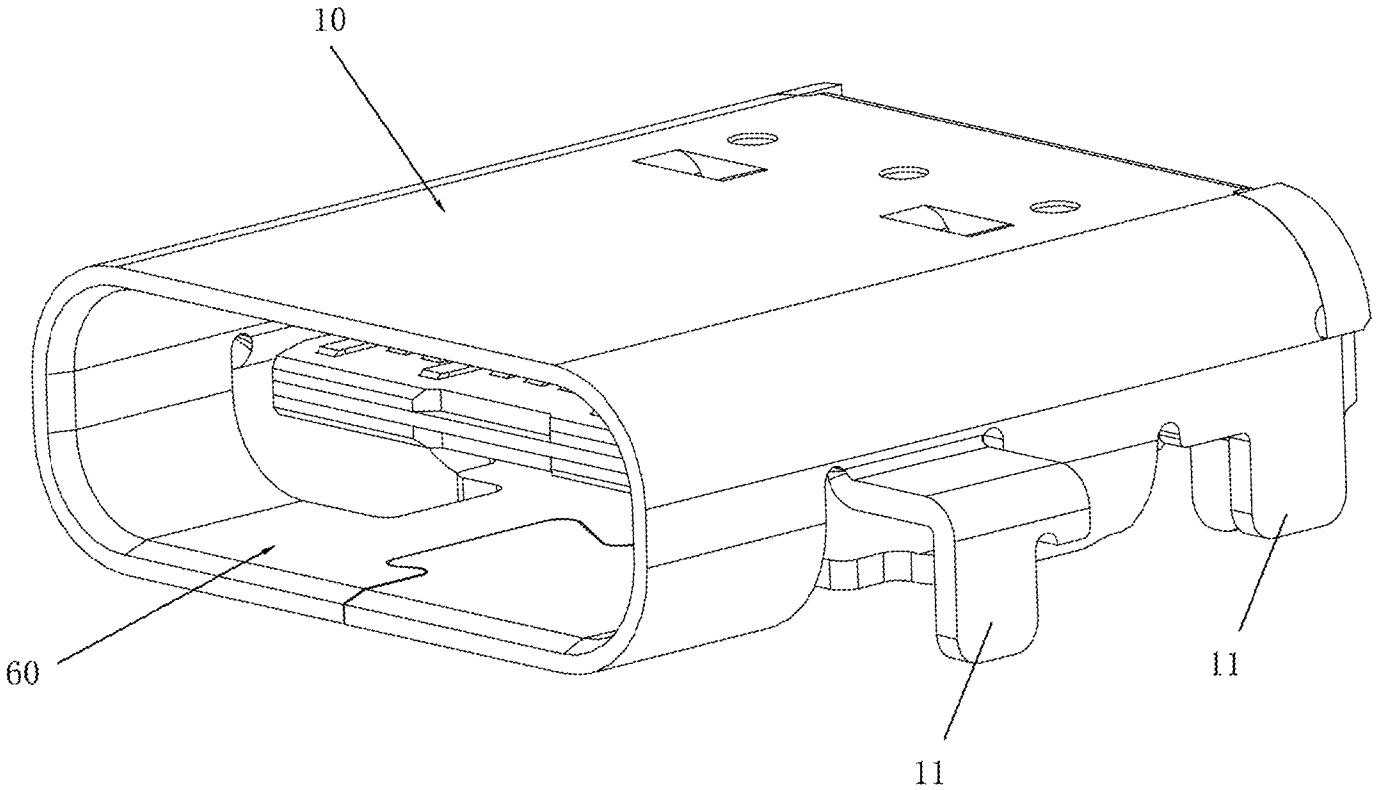
FIG. 11 is a stereoscopic assembly diagram according to Embodiment 3 of the present invention.
Figure 12:
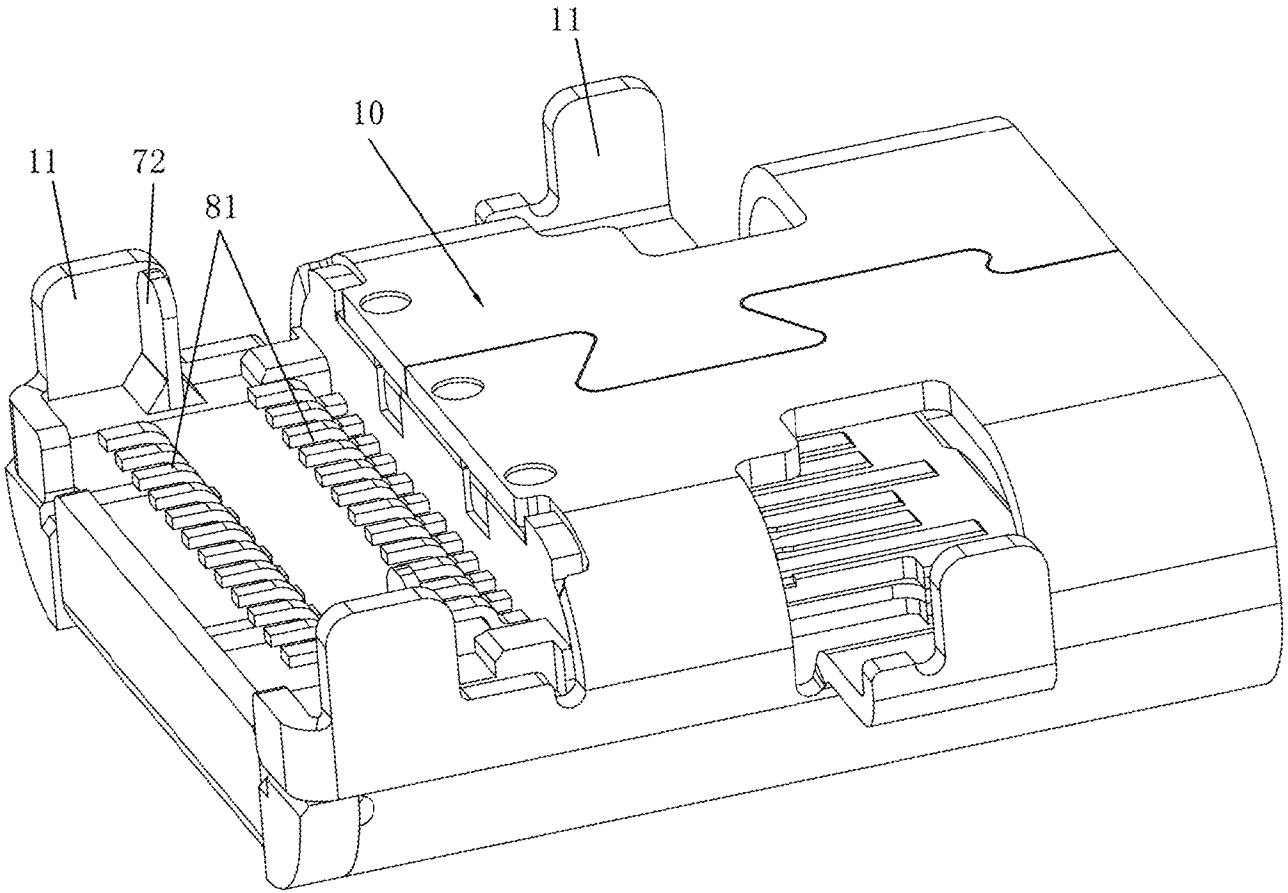
FIG. 12 is a stereoscopic assembly diagram from another perspective according to Embodiment 3 of the present invention.
Figure 13:
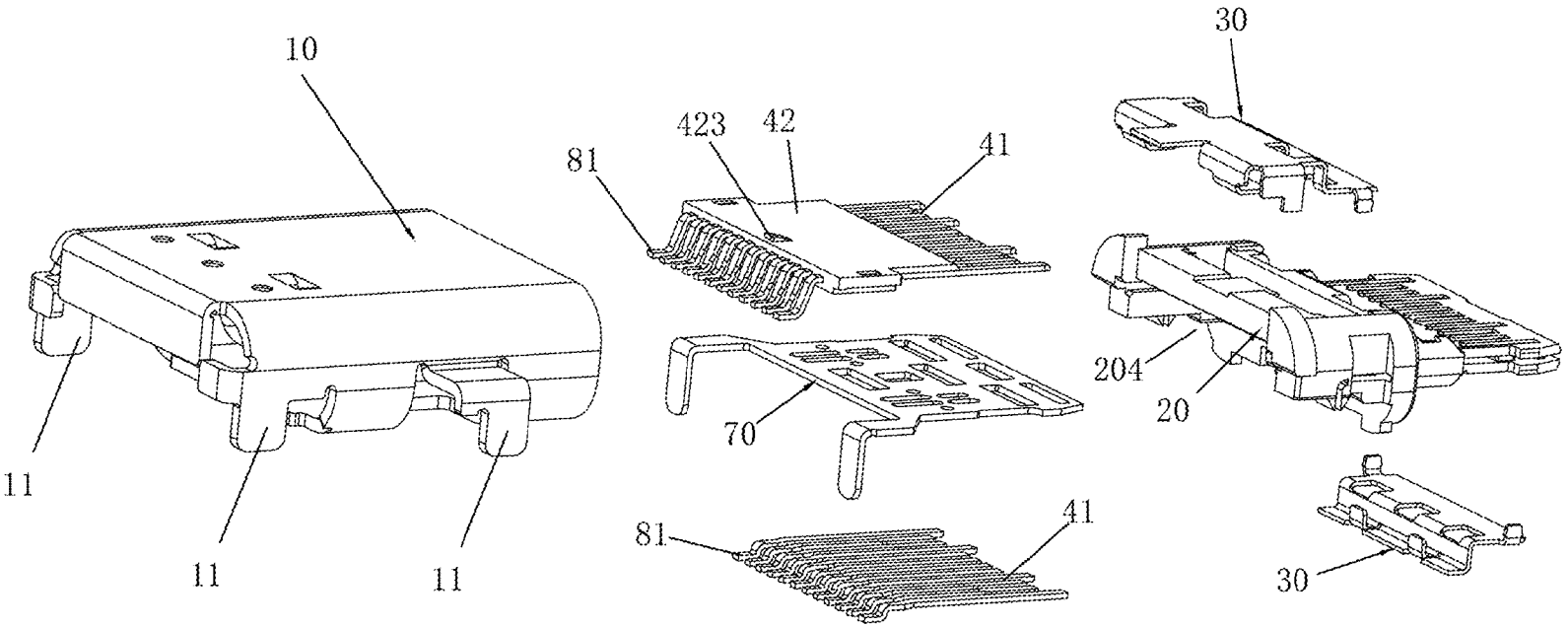
FIG. 13 is a first structural decomposition diagram according to Embodiment 3 of the present invention.
Figure 14:
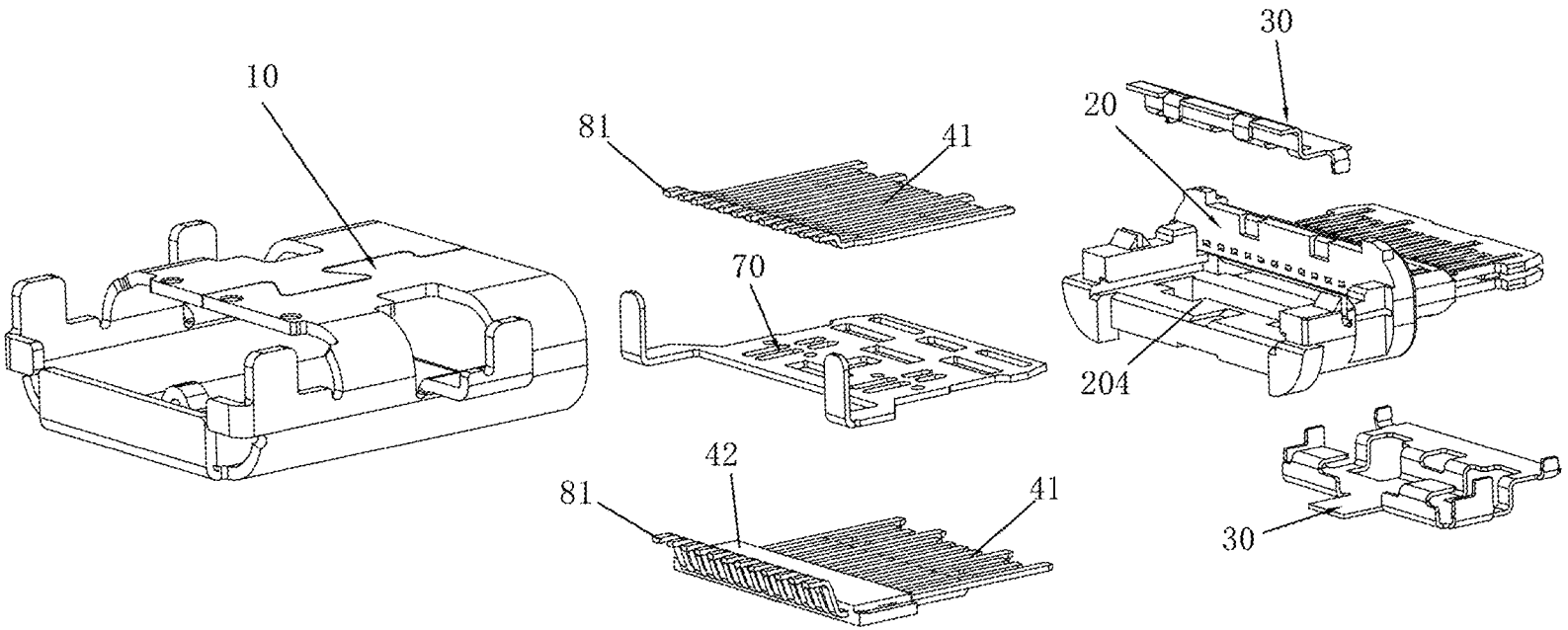
FIG. 14 is a second structural decomposition diagram according to Embodiment 3 of the present invention.
Figure 15:
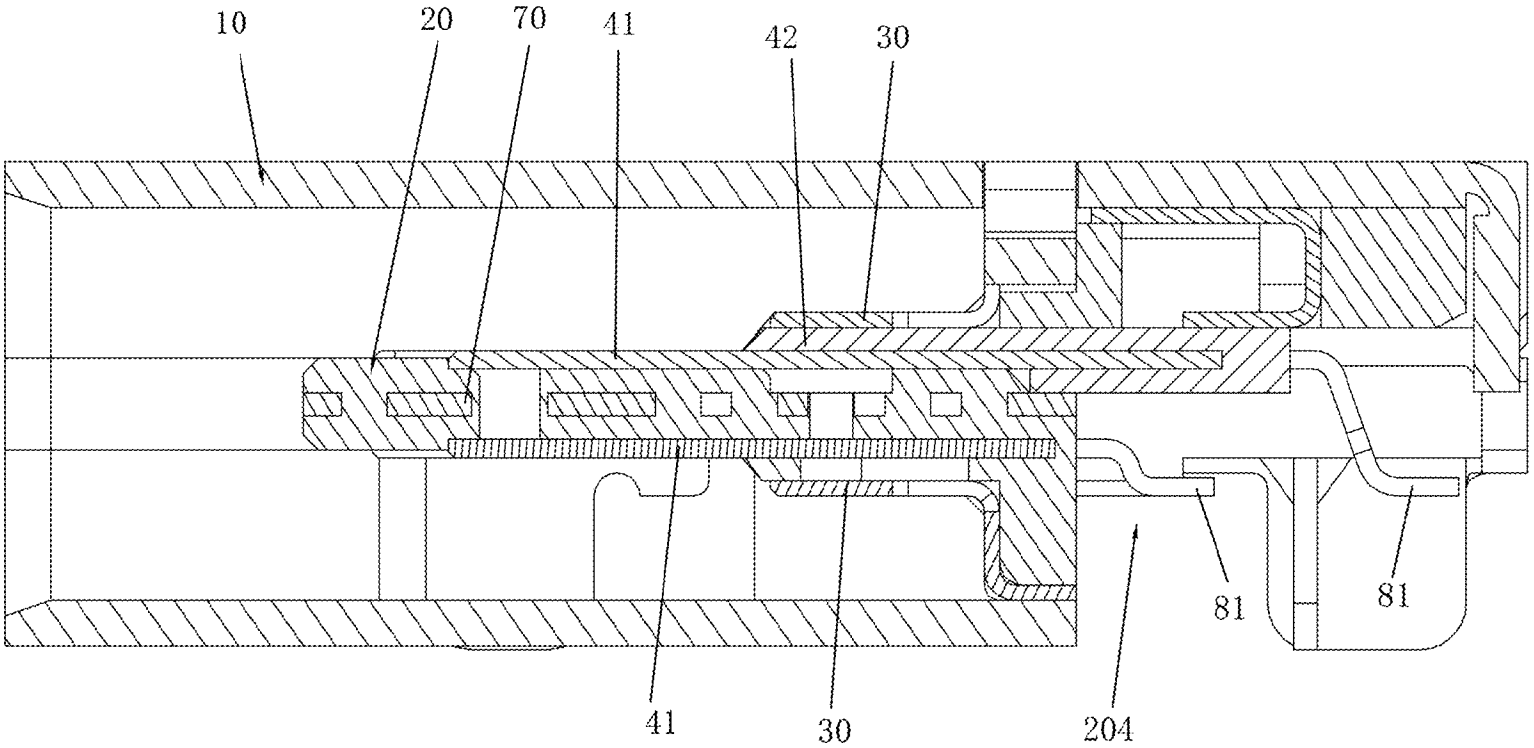
FIG. 15 is a cross-sectional structure diagram according to Embodiment 3 of the present invention.

The spacer 50 is located between the two rows of contact terminals 41 so as to isolate the two rows of contact terminals 41 from one another. A plurality of positioning holes 501 for reinforcing the firmness of connection between the spacer 50 and the insulating body 20 are formed on the spacer 50, and filled with insulating material during forming the insulating body 50. As shown in FIG. 5, the spacer 50 includes a first spacer portion 51 corresponding to the tongue plate 22 and a second spacer portion 52 corresponding to the base 21, a contact bulge 521 being outwards convexly provided on a side edge of the second spacer portion 52, the contact bulge 521 being connected to the inner wall of the shielding shell 10 in a close contact manner.

Figure 3:
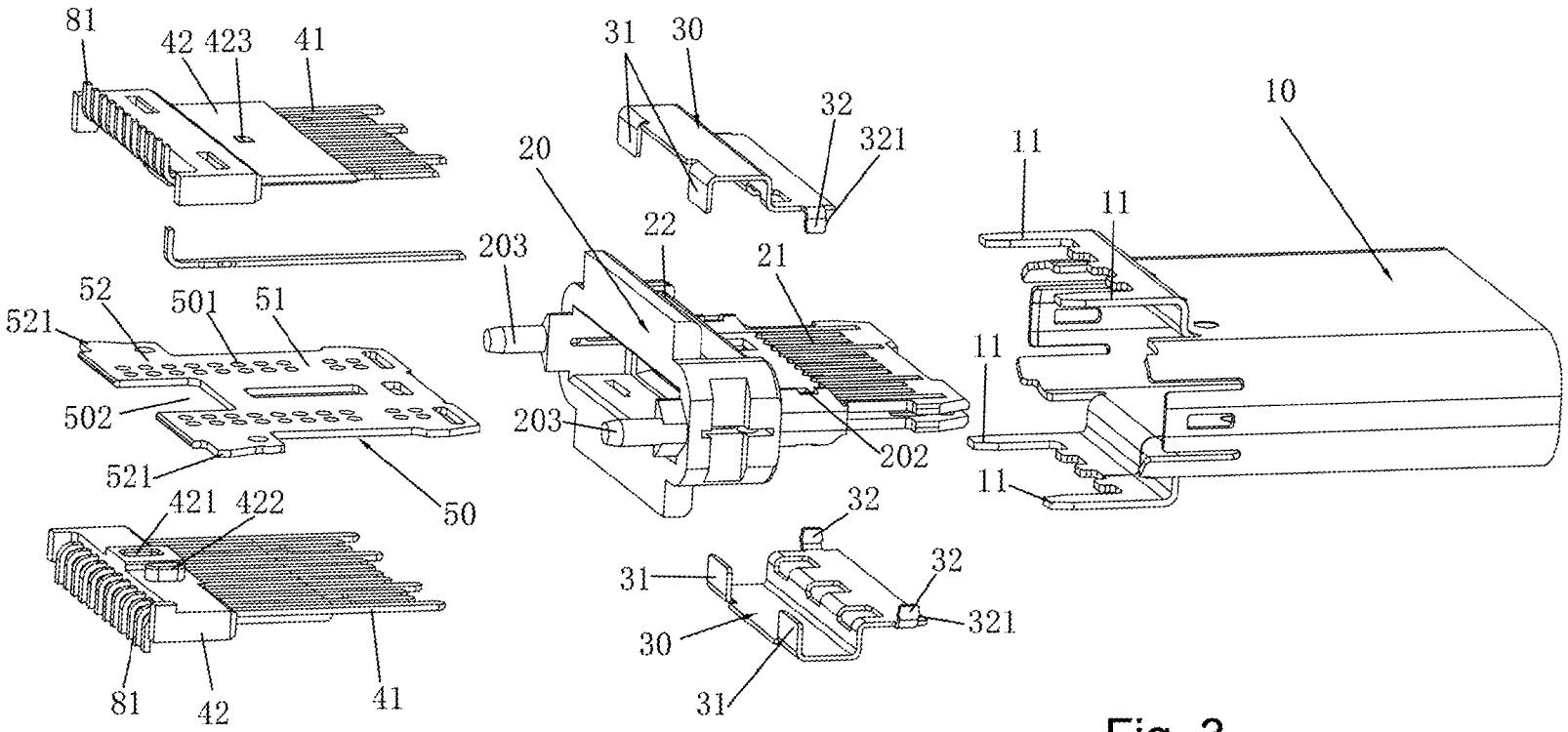
FIG. 3 is a structural decomposition diagram according to Embodiment 1 of the present invention.
Figure 4:
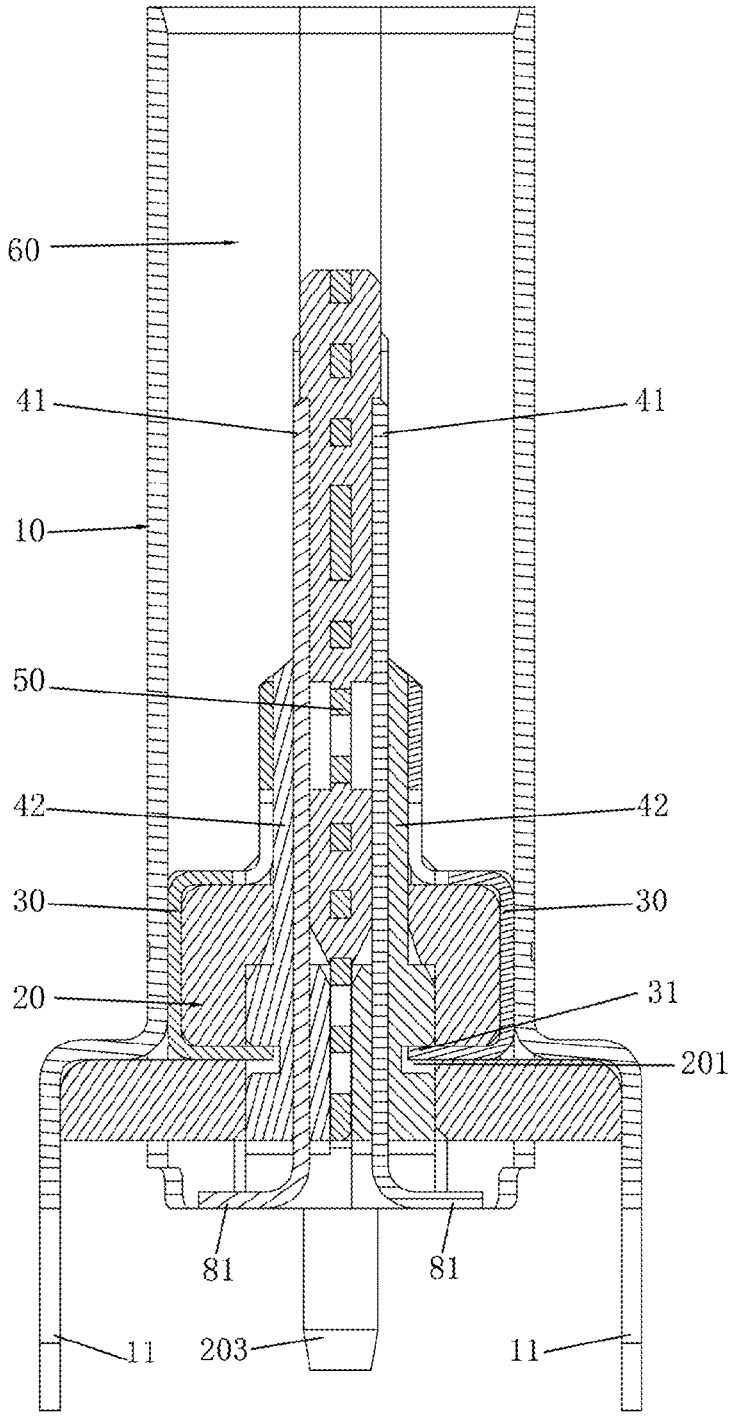
FIG. 4 is a first cross-sectional structure diagram according to Embodiment 1 of the present invention.

As shown in FIG. 3 and FIG. 4, in this embodiment, the two rows of contact terminals 41 are separately embedded into respective terminal ports 42 by primary embedment molding, the two terminal ports 42 being assembled in a superposed manner, a positioning recess 421 and a positioning lug 422 which are fitted with each other being provided on the assembling faces of the terminal ports, respectively, the positioning lug 422 being embedded into the positioning recess 421 of the opposite terminal port. As shown in FIG. 3, the terminal ports 42 are convexly provided thereon with limiting lugs 423 for facilitating the firm positioning of the terminal ports 42 and the insulating body 20. A downward-opening channel 502 is formed on the spacer 50 corresponding to a position where the positioning lug 422 and the positioning recess 421 are assembled together; and, the two terminal ports 42, the two rows of contact terminals 41 and the spacer 50 are formed within the insulating body 20 by secondary embedment molding.

The shielding shell 10 encloses the base 21 and the tongue plate 22, and a slot 60 is formed between the outer wall of the tongue plate 22 and the inner wall of the shielding shell 10 (as shown in FIG. 4). In a plug-in direction, a plurality of welding pins 11 extending towards a same direction are integrally provided at an end of the shielding shell 10, and positioning columns 203 extending towards a same direction are integrally provided at an end of the insulating body 20; and welding portions of the two rows of contact terminals 41 are curvedly extended towards the side of the insulating body 20 where the contact portions are located. As shown in FIG. 4, welding portions of the two rows of contact terminals 41 are curvedly extended in a vertical plug-in direction, respectively, and the welding portions of the two rows of contact terminals 41 are arranged oppositely, with a welding portion 81 thereof being of a surface mount structure.

As shown in FIG. 6 to FIG. 10, one embodiment of a DIP-type connector socket (horizontal) is shown. The main technical solution of this embodiment is the same as the foregoing embodiment, except for the following differences: two side faces of the shielding shell 10 are integrally extended downwards to form a plurality of welding pins 11 in the vertical plug-in direction; the two rows of contact terminals 41 are arranged up and down, with the upper row of contact terminals 41 being separately formed within one terminal port by primary embedment molding, and the terminal port 42, the upper row of contact terminals 41, the spacer and the lower row of contact terminals 41 all being formed within the insulating body 20 by secondary embedment molding; a downward-opening notch 204 convenient for the installation of a circuit board is formed on the bottom at the end of the insulating body 20 in the plug-in direction, and the welding portions of the upper row of contact terminals 41 are protruded from the bottom of the insulating body 20 and exposed into the downward-opening notch 204, with the exposed portion being of a surface mount structure 81 extending in the plug-in direction; and, the welding portions of the lower row of contact terminals 41 are curvedly protruded downwards in front and rear rows and exposed into the downward-opening notch 204, and the exposed portion is of a perforated plug-in structure 82.

Moreover, in this embodiment, instead of being in close contact connection to the shielding shell 10, the spacer 70 is connected to a circuit board by outgoing welding pin portion 72. Specifically, the spacer 70 includes a main body portion 71 and two welding pin portions integrally extending from two sides of the rear end of the main body portion 71 and curvedly protruded from the bottom of the insulating body 20, and the welding pin portions 72 and the welding pins 11 of the shielding shell 10 are arranged in a same direction. Of course, the spacer 70 is also provided thereon with the positioning holes, the downward-opening channel and other structures.

As shown in FIG. 11 to FIG. 15, one embodiment of an SMT (sinking plate) connector socket. The main technical solution of this embodiment is the same as Embodiment 1 and Embodiment 2. This embodiment differs from Embodiment 2 in that: the welding portions of the upper row of contact terminals 41 and the lower row of contact terminals 42 are protruded from the bottom of the insulating body 20 and exposed into the downward-opening cavity 204 in respective rows, and the exposed portion is of a surface mount structure 81 extending in the plug-in direction.

The key design point of the present invention is that, the structure design of the shielding shell, the insulating body, the two baffles, the two rows of contact terminals and the spacer and the assembly relationship thereof allow the positioning between assembly components to be quite firm; particularly, the positioning between upper and lower terminal groups is more accurate and firm, so that it is advantageous for the improvement of the contact performance of terminals and the stable signal transmission is ensured; moreover, each component is simple in structure and easy to manufacture, and the technical solution thereof is widely applied to connector sockets of various styles and models.

The foregoing description merely shows preferred embodiments of the present invention, and is not intended to limit the technical scope of the present invention. Therefore, any tiny modification, equivalent change and embellishment made to the foregoing embodiments in accordance with the technical essence of the present invention shall fall into the scope of the technical solutions of the present invention.

What is claimed is:

1. A connector socket, comprising a shielding shell, an insulating body and two baffles disposed on two opposite sides of the insulating body, and further comprising two rows of contact terminals and a spacer all embedded into the insulating body, wherein the insulating body comprises a base and a tongue plate connected to a front end of the base, the two rows of contact terminals being exposed from two opposite sides of the tongue plate, respectively, the two baffles being disposed to correspond to the sides where the two rows of contact terminals are located, respectively; the spacer is located between the two rows of contact terminals so as to isolate the two rows of contact terminals from one another; a plurality of positioning holes for reinforcing the firmness of connection between the spacer and the insulating body are formed on the spacer, and filled with insulating material during forming the insulating body; and the shielding shell encloses the base and the tongue plate, and a slot is formed between the outer wall of the tongue plate and the inner wall of the shielding shell, wherein a positioning pin and a locking pin are integrally extended from each of the baffles towards the insulating body and a positioning slot and a locking slot are correspondingly formed on the insulating body, the positioning pin being embedded into the positioning slot; and a clamping bulge is convexly provided on the locking pin, the clamping bulge being in close fit with an inner wall of the locking slot when the locking pin is embedded into the locking slot.

2. The connector socket according to claim 1, wherein, in a plug-in direction, a plurality of welding pins extending towards a same direction are integrally provided at an end of the shielding shell, and positioning columns extending towards a same direction are integrally provided at an end of the insulating body; welding portions of the two rows of contact terminals are curvedly extended towards the side of the insulating body where the contact portions are located; the spacer comprises a first spacer portion corresponding to the tongue plate and a second spacer portion corresponding to the base, a contact bulge being outwards convexly provided on a side edge of the second spacer portion, the contact bulge being connected to the inner wall of the shielding shell in a close contact manner.

3. The connector socket according to claim 2, wherein the two rows of contact terminals are separately embedded into respective terminal ports by a primary embedment molding, the two terminal ports being assembled in a superposed manner, a positioning recess and a positioning lug which are fitted with each other being provided on the assembling faces of the terminal ports respectively, the positioning lug being embedded into the positioning recess of the opposite terminal port; a downward-opening channel is formed on the spacer corresponding to a position where the positioning lug and the positioning recess are assembled together; and, the two terminal ports, the two rows of contact terminals and the spacer are formed within the insulating body by a secondary embedment molding.

4. The connector socket according to claim 3, wherein the terminal ports are convexly provided thereon with limiting lugs for facilitating the firm positioning of the terminal ports and the insulating body.

5. The connector socket according to claim 3, wherein welding portions of the two rows of contact terminals are curvedly extended in a vertical plug-in direction, respectively, and the welding portions of the two rows of contact terminals are arranged oppositely; and, the connector socket is of a vertical structure, with a welding portion thereof being of a surface mount structure.

6. The connector socket according to claim 1, wherein two side faces of the shielding shell are integrally extended downwards to form a plurality of welding pins in the vertical plug-in direction; the two rows of contact terminals are arranged up and down, the upper row of contact terminals being separately formed within one terminal port by a primary embedment molding, the terminal port, the upper row of contact terminals, the spacer and the lower row of contact terminals being formed within the insulating body by a secondary embedment molding; a downward-opening notch convenient for the installation of a circuit board is formed on the bottom at the end of the insulating body in the plug-in direction, the welding portions of the upper row of contact terminals being protruded from the bottom of the insulating body and exposed into the downward-opening notch, the exposed portion being of a surface mount structure extending in the plug-in direction; and, the welding portions of the lower row of contact terminals are curvedly protruded downwards in front and rear rows and exposed into the downward-opening notch, and the exposed portion is of a perforated plug-in structure.

7. The connector socket according to claim 6, wherein the spacer comprises a main body portion and two welding pin portions integrally extending from two sides of the rear end of the main body portion and curvedly protruding from the bottom of the insulating body, and the welding pin portions and the welding pins of the shielding shell are arranged in a same direction.

8. The connector socket according to claim 6, wherein the terminal ports are convexly provided thereon with limiting lugs for facilitating the firm positioning of the terminal ports and the insulating body.

9. The connector socket according to claim 1, wherein two side faces of the shielding shell are integrally extended downwards to form a plurality of welding pins in the vertical plug-in direction; the two rows of contact terminals are arranged up and down, the upper row of contact terminals being separately formed within one terminal port by a primary embedment molding, the terminal port, the upper row of contact terminals, the spacer and the lower row of contact terminals being formed within the insulating body by a secondary embedment molding; a downward-opening notch convenient for the installation of a circuit board is formed on the bottom at the end of the insulating body in the plug-in direction, the welding portions of the upper row of contact terminals and the lower row of contact terminals being protruded from the bottom of the insulating body and exposed into the downward-opening cavity in respective rows, the exposed portion being of a surface mount structure extending in the plug-in direction.

10. The connector socket according to claim 9, wherein the spacer comprises a main body portion and two welding pin portions integrally extending from two sides of the rear end of the main body portion and curvedly protruding from the bottom of the insulating body, and the welding pin portions and the welding pins of the shielding shell are arranged in a same direction.

11. The connector socket according to claim 9, wherein the terminal ports are convexly provided thereon with limiting lugs for facilitating the firm positioning of the terminal ports and the insulating body.

* * * * *